United States Patent [19]

Takaoka et al.

[11] 4,325,750

[45] Apr. 20, 1982

[54] METHOD FOR MANUFACTURING A STRANDED CONDUCTOR FOR AN ELECTRIC POWER CABLE

[75] Inventors: Michio Takaoka, Chiba; Tsuneaki Mohtai, Yachiyo; Syotaroh Yoshida; Kazuo Watanabe, both of Tokyo, all of Japan

[73] Assignee: The Fujikura Cable Works, Limited, Tokyo, Japan

[21] Appl. No.: 261,473

[22] Filed: May 7, 1981

Related U.S. Application Data

[60] Continuation-in-part of Ser. No. 134,996, Mar. 28, 1980, abandoned, which is a division of Ser. No. 41,334, May 22, 1979, abandoned.

[30] Foreign Application Priority Data

Nov. 9, 1978 [JP] Japan ..... 53-138066

[51] Int. Cl.[3] ..... C23F 7/02

[52] U.S. Cl. ..... 148/6.14 R; 118/44; 118/420; 118/428; 427/434.4; 174/110 A

[58] Field of Search ..... 118/424, 44, 428, DIG. 19, 118/DIG. 22, 405; 174/110 A, 5 R, 5 E, 5 FC, 5 S, 116; 427/434.4, 434.6; 57/241, 217, 221, 223, 7

[56] References Cited

U.S. PATENT DOCUMENTS

| | | | |
|---|---|---|---|
| 1,904,162 | 4/1933 | Millikin | 174/110 A |
| 2,460,896 | 2/1949 | Meyer | 148/6.14 R |
| 3,885,380 | 5/1975 | Hacker | 57/223 |

FOREIGN PATENT DOCUMENTS

| | | | |
|---|---|---|---|
| 287503 | 2/1929 | United Kingdom | 174/110 A |

*Primary Examiner*—Ralph S. Kendall

[57] ABSTRACT

In a method for manufacturing a stranded conductor for an electric power cable comprising a process for forming insulating films by passing an uninsulated stranded conductor constituted by a plurality of stranded conductive strands through oxidizing liquid, the stranded conductor passing through the liquid is curved at an angle of 3° to 10° in a predetermined path to form gaps between the strands, and the oxidizing liquid is caused to penetrate between the strands through the gaps to form oxide films on the surfaces of the strands.

2 Claims, 11 Drawing Figures

METHOD FOR MANUFACTURING A STRANDED CONDUCTOR FOR AN ELECTRIC POWER CABLE

CROSS-REFERENCE TO THE RELATED APPLICATION

This is a continuation-in-part application of our copending application Ser. No. 134,996, filed Mar. 28, 1980, abandoned, which in turn is a divisional application Ser. No. 41,334, filed May 22, 1979, abandoned.

BACKGROUND OF THE INVENTION

This invention relates to a method for manufacturing a stranded conductor for an electric power cable, constituted by 800 strands twisted together.

Accompanying the remarkable increase in the electric power consumption, the amount of power transmission has been increasing steadily. With such increase of the power transmission capacity, large-size conductors for power cable have come into use. Recently there has been put into practical use a conductor constituted by 800 strands each 2–3 mm in diameter and having a cross section of 2,000 to 6,000 $mm^2$.

These large-size conductors, however, are subject to a significant defect—AC losses due to the skin effect, proximity effect, etc. Namely, the increase of the AC resistance due to the skin and/or proximity effects suppresses the increase of the transmission capacity. In order to reduce such AC losses, so-called multi-segmental conductors have been developed. The multi-segmental conductor may be obtained by preparing a small-size segment formed of shaped stranded conductor, applying the insulation over the segment, and laying up several such small-size stranded segments into a large-size conductor. Also developed has been an insulating-film-coated stranded conductor in which each strand is covered with an insulating film.

FIG. 1 shows skin effect characteristics of three conductors of different types with respect to the cross-sectional areas thereof. In FIG. 1, a characteristic curve A represents a case of an insulating-film-coated stranded conductor, while curves B and C represent cases of an oil-filled cable conductor and a pipe-type-oil-filled cable conductor, respectively. As is evident from FIG. 1, the insulating-film-coated stranded conductor is the lowest among others in the coefficient of skin effect for every cross-sectional area, and also in the increasing rate of the coefficient of skin effect relative to the increase in the cross-sectional area of the conductor. Namely, the larger the cross-sectional area becomes, the more favorable the insulating-film-coated stranded conductor becomes as compared with the other types.

An enamel coating method has been generally used for the insulation of a strand. The enamel coating method, however, has a drawback to be high cost. Also available is a method to form a surface oxide film on a strand by oxidizing the surface of every strand. In this method, each strand is individually immersed in oxidizing liquid to form an oxide film on the surface of the strand, for example. A plurality of such strands each covered with an oxide film are stranded to form a conductor for cable. In this case, however, the strands already covered with the oxide films are stranded by means of an external force, to cause a relatively large frictional force to occur between the strands in the course of stranding, thereby exfoliating the oxide films on the surfaces of the strands.

Furthermore, there is a method to immerse a stranded conductor in oxidizing liquid to oxidize the surface of each strand. In such method, however, there is a drawback in the following that the strands are stranded tight at a stage where the conductor is immersed in the liquid, so that the oxidizing liquid will not be able to penetrate deep into the gap between the strands of the immersed conductor, thus oxidizing only the exposed surfaces of strands at the superficial portions of the strands.

SUMMARY OF THE INVENTION

Accordingly, an object of the invention is to provide a method for manufacturing a stranded conductor for an electric power cable, constituted by a plurality of strands which are twisted together and each of which is covered with an oxide film free from an exfoliation.

According to the invention, there is provided a method for manufacturing a stranded conductor for an electric power cable, comprising the step of: advancing a conductor constituted by a plurality of stranded uninsulated conductive strands through a bath of oxidizing liquid in a predetermined path, while the conductor is curved in a wavy fashion at an angle of 3° to 10° to the path, thereby coating and forming an oxide film on each of said strands while maintaining the elasticity of the conductor.

DETAILED DESCRIPTION OF THE PREFERRED EMBODIMENTS

Figure 1:
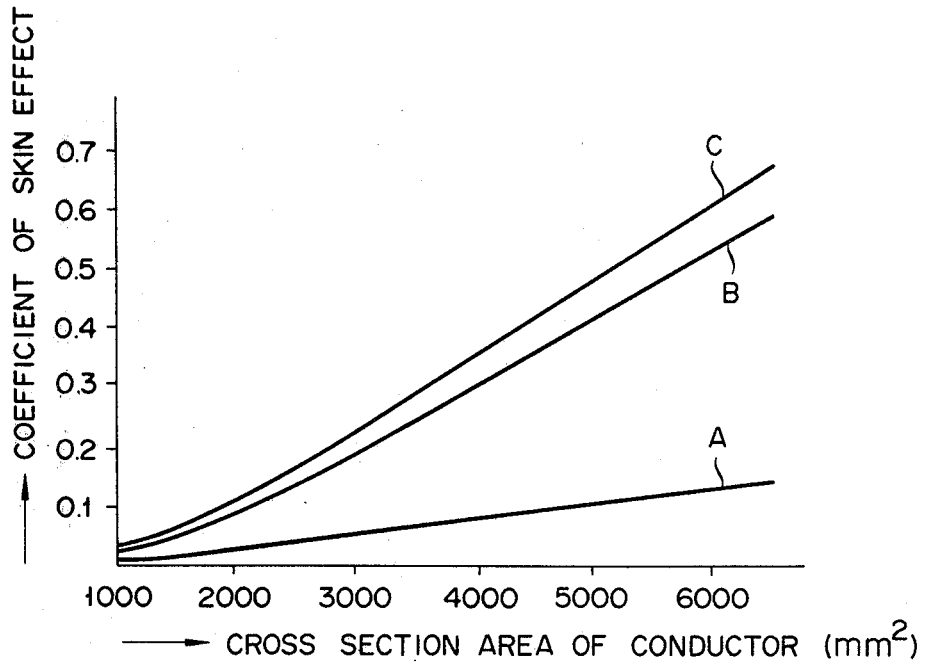
FIG. 1 shows the relationship between the cross-sectional areas of various conductors of different types and the coefficient of skin effect.
Figure 2:
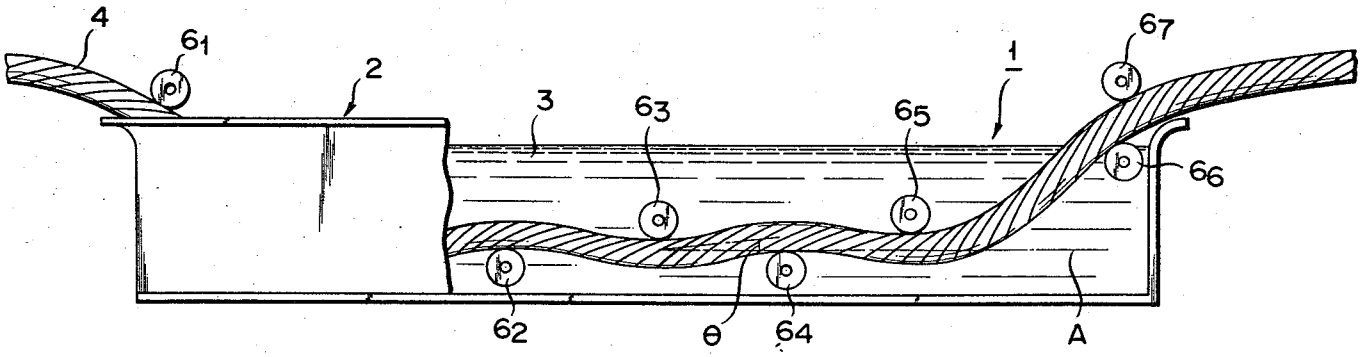
FIG. 2 shows the structure of an apparatus used in a process for executing the manufacturing method of this invention.

FIG. 2 shows a process for illustrating the method for manufacturing a stranded conductor constituted by insulated conductive strands free from any exfoliated insulating oxide film, according to this invention. In FIG. 2, there is shown a step in which the conductor constituted by a plurality of stranded conductive bear strands passes through oxidizing liquid, thereby oxidizing the surfaces of the strands constituting the conductor.

Besides the aforesaid surface oxidizing process, though including various processes of the conventional manufacturing method, for example, conductor paying-off, taking-up, rinsing and drying processes, the method for manufacturing the stranded conductor of the invention is specially characterized by the oxidizing process, and the other processes are to be executed in accordance with the conventional systems. Accordingly, FIG. 2 illustrates only the oxidizing process, for the simplicity of the drawing.

Figure 3:
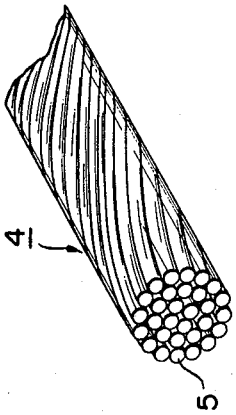
FIG. 3 is an enlarged perspective view of a stranded conductor to be subjected to an oxidation process as shown in FIG. 2.

In FIG. 2, numeral 1 designates an apparatus for the surface oxidation, in which a bath 2 is filled with oxidizing liquid 3. To facilitate the understanding of the construction of the apparatus, a wall member constituting the bath 2 is partially broken. Numeral 4 designates a conductor to be passed through the oxidizing liquid 3 for oxidation treatment. FIG. 3 shows an enlarged perspective view of part of the conductor.

Figure 4:
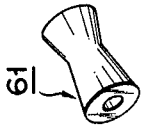
FIG. 4 is a perspective view of a guide roller.

As is evident from FIG. 3, the conductor 4 is constituted by a plurality of stranded conductive strands 5. A guide roller $6_1$, which has its axial central portion constricted as perspectively shown in FIG. 4, is rotatably attached to a frame (not shown) of the apparatus at right angles to the running direction of the conductor 4. Guide rollers $6_2$, $6_3$, $6_4$ and $6_5$ are rotatably attached between two facing walls of the bath 2 at positions vertically slightly shifted from one another. The guide rollers $6_2$, $6_3$, $6_4$ and $6_5$ tend to cause the conductor 4 passing through the oxidizing liquid 3 in the bath 2 to meander up and down. Specifically, the conductor 4 is advanced through the bath 2 of the oxidizing liquid 3 in such a predetermined path as shown by a character A, while curved in a wavy fashion at an angle $\theta$ of 3° to 10° in the predetermined path. Guide rollers $6_6$ and $6_7$ direct the conductor 4 from the liquid 3 toward the outside. Although not shown, a feed mechanism (e.g. feed roller) for feeding the conductor 4 and a take-up mechanism (e.g. taken-up roller) are disposed, as required, on the left and right sides of the apparatus of FIG. 2, respectively. The guide rollers $6_2$ and $6_7$ may be of the same construction as that of the guide roller $6_1$ as shown in FIG. 4.

Now there will be described the conductor manufacturing method of the invention employing the apparatus as shown in FIG. 2.

The conductor 4 is delivered from the feed mechanism (not shown) by the drive of the feed mechanism and take-up mechanism (not shown), and directed toward the oxidizing liquid 3 by the action of the guide roller $6_1$ to pass through the liquid 3. When advancing in the liquid 3, the conductor 4 is windingly directed as illustrated with its passage through each of the guide rollers $6_2$ to $6_5$ that are located at various heights, moving wavily or windingly in the liquid 3. More precisely, the conductor 4 is curved at the angle $\theta$ of 3° to 10° in the liquid 3 by the rollers $6_2$ to $6_5$. When the conductor 4 is curved at the angle $\theta$ of 3° to 10° by the guide rollers $6_2$ and $6_5$, narrow gaps of 10 to 100 microns are created between the strands 5 constituting the conductor 4. The oxidizing liquid 3 penetrates through these gaps, thus reaching inner strands as well as strands in the vicinity of the outer periphery of the conductor. Consequently, oxide films (e.g. CuO films for copper strands) are formed on the surfaces of not only the peripheral strands but also the inner ones. The oxidized conductor 4 is led to the outside by means of the guide rollers $6_6$ and $6_7$, washed in water and dried in conventional methods, and then wound on the take-up mechanism (not shown). Alternatively, the conductor after drying may be delivered as it is for a cutting process to cut the conductor into suitable lengths, without being wound. Although not absolutely required, the washing and drying processes are preferably executed.

The gaps created between the strands 5 due to the curving by the guide rollers $6_2$ to $6_5$ in the oxidizing process must be removed after such process. Since the guide rollers $6_2$ and $6_5$ in the bath 2 are arranged with relatively small differences in height, the gaps between the strands 5 caused by the guide rollers $6_2$ to $6_5$ are narrow. Therefore, those gaps between the strands 5 may be removed by applying a tensile force created by the conventional winding process. Thus, the gaps between the strands 5 are relatively small, so that the removal of such gaps needs no great external force, only requiring the winding force applied to the conductor 4 in the winding process. The stress on the strands 5, therefore, is small, so that the oxide film on the surface of each strand 5 will never exfoliate.

The conductor 4 has its own righting moment, whereby the gaps between the strands 5 can also be removed without utilizing the winding force in the winding process.

When using a copper wire for the strand 5, the oxidizing liquid 3 should preferably be a mixed solution of 5% sodium chlorite and 5% sodium hydroxide.

The solution has a very low viscosity, generally about 0.35 pascal.

According to the manufacturing method of this invention, there may be provided the relatively inexpensive conductor 4 formed of the strands 5 with no exfoliated oxide film portion by delicately wavily curving by an angle of 3° to 10° the conductor 4 passing through the oxidizing liquid 3 by means of the plurality of guide rollers $6_2$ and $6_5$ disposed with differences in height, causing the oxidizing liquid 3 to penetrate into the gaps between the strands 5 created by the curving, thereby effectively forming oxide films on the surface of the strands 5, and removing the gaps by the winding force applied to the conductor 4 in the winding process or by the righting moment of the conductor 4 itself where the winding process is omitted.

The conductor is curved at an angle of 3° to 10° as described above. The reasons for this are as follows:

(1) The conductor consists of 800 strands each 2–3 mm in diameter, for example, and has a cross section of 2,000–6,000 mm$^2$. The conductor is thick and rigid. It is hard to bend the conductor at a large angle. If forcedly bent at a large angle, the conductor will be permanently bent partly because each of the strands is permanently bent and partly because the mutual displacement of adjacent strands is retained due to a large friction between them after the bending force is taken off the conductor. The conductor must not bent too much.

(2) The conductor is bent while being advanced through the bath of oxidizing liquid so as to form a gap between adjacent strands and to allow the oxidizing liquid to flow into the gap. The oxidizing liquid has a very low viscosity, generally about 0.35 pascal. It can flow into a gap as small as 10 to 100 microns. To provide such a small gap between adjacent strands it is sufficient to bend the conductor at 3° to 10°.

Figure 5:
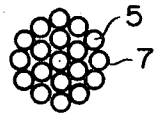
FIG. 5 is a cross-sectional view of the conductor after having undergone the oxidation process.
Figure 6:
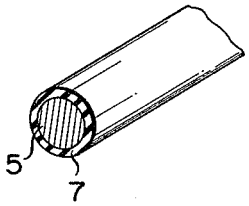
FIG. 6 is an enlarged perspective view of one of the strands of the conductor after having undergone the oxidation process.
Figure 7:
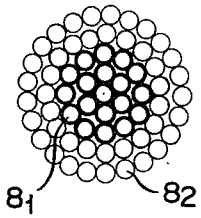
FIG. 7 is a cross-sectional view showing another form of the conductor provided by the manufacturing method of the invention.
Figure 8:
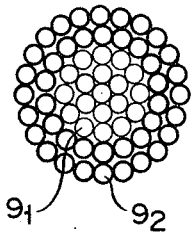
FIG. 8 is a cross-sectional view showing still another form of the conductor.

FIG. 5 shows a cross-sectional view of the conductor provided by the manufacturing method of the invention. As shown in FIG. 5, uniform and exfoliation-free oxide films 7 (represented by circles described by thick lines in FIG. 5) are formed on the surfaces of all the strands 5, including the strands arranged in the inner part of the conductor as well as the strands on the outer periphery of the conductor. The conductor of such structure will hardly be subject to the skin effect, proximity effect, etc. Moreover, according to the manufacturing method of the invention, the conductor obtained may be relatively inexpensive because of the insulating films 7 formed on the individual strands 5 by oxidizing the surfaces thereof. FIG. 6 is an enlarged perspective view of one of the strands 5 of the conductor as shown in FIG. 5, for the clear illustration of the surface oxide film 7 on the strand 5. It is unnecessary to apply the surface oxidation to all the strands 5 that constitute the stranded conductor 4; a double-layer conductor with only inner strands $\mathbf{8}_1$ oxidized and outer strands $\mathbf{8}_2$ unoxidized, as shown in FIG. 7, may be obtained by previously applying, for example, oil to the peripheral strands among the strands forming the conductor 4 before the execution of the oxidation process, thereby preventing the surface of such oiled strands from being oxidized in the oxidation process. In contrast with this, as shown in FIG. 8, the conductor obtained may have its inner strands $\mathbf{9}_1$ unoxidized and outer strands $\mathbf{9}_2$ oxidized.

Figure 9:
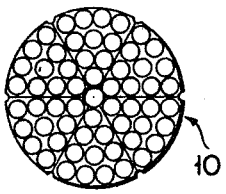
FIG. 9 is a cross-sectional view showing a further form of the conductor.
Figure 10:
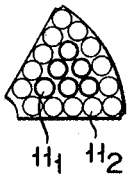
FIG. 10 is a cross-sectional view showing a form of a conductor segment constituting the conductor of FIG. 9.
Figure 11:
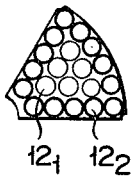
FIG. 11 is a cross-sectional view showing another types of the conductor segment as shown in FIG. 10.

Also, this invention may be applied to a segmental conductor consisting of a plurality of sector-shaped segments, as shown in FIG. 9. Such conductor may be obtained by preparing segments 10 consisting of a plurality of stranded conductive strands 5 according to the manufacturing method of the invention, and then stranding a plurality of such segments together. Although the segmental conductor shown in FIG. 9 is formed of six segments 10, it is to be understood that there may also be obtained a conductor consisting of four, five, eight, nine, ten or twelve segments. The number of segments need not be limited to the number mentioned. Moreover, it is unnecessary to oxidize all the strands that constitute each segment; strands at only a specified portion are to be oxidized for insulation, like the case of FIGS. 7 or 8. A segment shown in FIG. 10 has its inner strands $\mathbf{11}_1$ insulated and peripheral strands $\mathbf{11}_2$ uninsulated. In contrast with this, FIG. 11 shows a conductor segment with inner strands $\mathbf{12}_1$ uninsulated and peripheral strands $\mathbf{12}_2$ insulated.

It is to be understood that the strands may be stranded in alternate directions or in one and the same direction.

What we claim is:

1. A method for manufacturing a stranded conductor for an electric power cable, comprising the step of: advancing a stranded conductor constituted by a plurality of stranded uninsulated conductive strands through a bath of oxidizing liquid in a predetermined path, while said conductor is curved in a wavy fashion at an angle of 3° to 10° to said path, thereby coating and forming an oxide film on each of said strands while maintaining the elasticity of the conductor.

2. A manufacturing method according to claim 1, wherein each of said conductive strand is a copper wire, and said oxidizing liquid is a mixed solution of 5% sodium chlorite and 5% sodium hydroxide.

* * * * *